United States Patent [19]

Seidl

[11] 4,369,740

[45] Jan. 25, 1983

[54] VALVE-ACTUATING LEVER

[75] Inventor: Jiri Seidl, Munich, Fed. Rep. of Germany

[73] Assignee: Bayerische Motoren Werke A.G., Munich, Fed. Rep. of Germany

[21] Appl. No.: 123,470

[22] Filed: Feb. 21, 1980

Related U.S. Application Data

[63] Continuation of Ser. No. 856,582, Dec. 1, 1977, abandoned.

[30] Foreign Application Priority Data

Dec. 1, 1976 [DE] Fed. Rep. of Germany ..... 2654528

[51] Int. Cl.[3] ..... F01L 1/20

[52] U.S. Cl. ..... 123/90.45; 123/90.44

[58] Field of Search ..... 123/90.39, 90.42, 90.44, 123/90.45, 90.46, 90.41, 90.47; 74/519, 559, 569

[56] References Cited

U.S. PATENT DOCUMENTS

| | | | |
|---|---|---|---|
| 1,264,083 | 4/1918 | Jouffret | 123/90.45 |
| 1,612,792 | 1/1927 | Asbury | 74/519 |
| 2,094,019 | 9/1937 | Notter | 74/519 |
| 2,365,401 | 12/1944 | Fisk | 123/90.45 |
| 2,844,132 | 7/1958 | Momtchiloff | 123/90.42 |
| 3,880,128 | 4/1975 | Stirrat | 123/90.45 |

*Primary Examiner*—Craig R. Feinberg
*Assistant Examiner*—W. R. Wolfe
*Attorney, Agent, or Firm*—Paul M. Craig, Jr.

[57] ABSTRACT

A valve-actuating lever, especially a rocker arm or drag lever, for internal combustion engines which is provided at its end actuating the valve on both sides of the valve abutment surface with one lateral guide surface each; the valve abutment surface is thereby formed at a valve-clearance adjusting element fixed at the lever between the lateral guide surfaces.

10 Claims, 8 Drawing Figures

Fig. 1
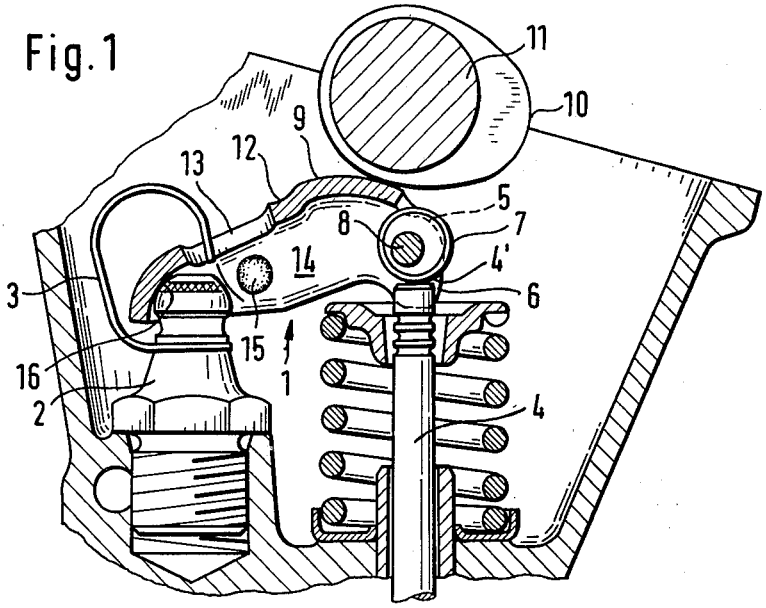
Fig. 2
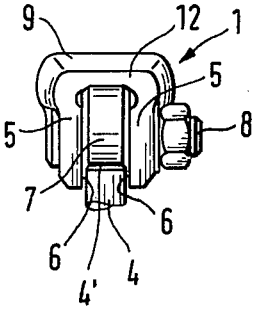
Fig. 3
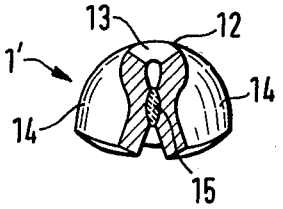
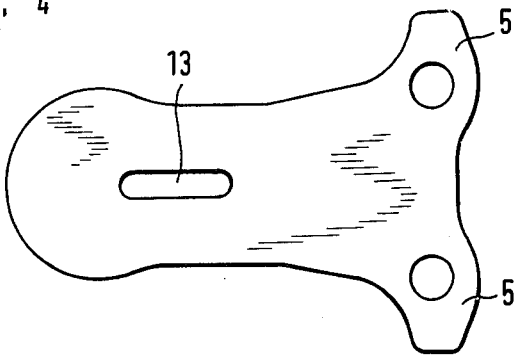
Fig. 4

VALVE-ACTUATING LEVER

This is a continuation of application Ser. No. 856,582, filed Dec. 1, 1977, now abandoned.

The present invention relates to a valve-actuating lever, especially to a rocker arm or drag lever, for internal combustion engines, which is provided at its end actuating the valve on both sides of the valve abutment surface with one lateral guide surface each.

The prior art valve-actuating levers of this type of construction (German Pat. No. 939,057, German Offenlegungsschrift No. 1,925,772 and German Gebrauchsmuster No. 1,845,656) are provided with formed-on or attached lateral guide surfaces and are supported on a manually or hydraulically longitudinally adjustable ball pin or spherical bolt. This arrangement entails the disadvantage that the geometric relationships of the valve actuation change considerably during the valve-clearance adjustment as a result of the transmission or translation ratio between the valve stroke and the cam stroke. The control periods change therewith, which may influence especially the power output and the exhaust gas composition. Another disadvantage is the difficult and expensive machining of the valve abutment surface between the two lateral guide surfaces as well as the costly construction of the ball pin or spherical bolt as a threaded member with a differential thread or as hydraulic piston.

In another prior art arrangement of this type (Daimler-Benz passenger motor vehicle engines), an intermediate compensating member is arranged between the drag lever and the valve stem, which includes the lateral guide surfaces. The valve-clearance is thereby adjusted both on the bearing side of the drag lever by means of the ball pin or spherical bolt as also stepwise on the valve side by means of the exchangeable intermediate compensating member. Though the geometric relationships change little in that arrangement and the machining of the valve abutment surfaces without lateral guide surfaces is simple, the combination of a drag lever with a ball pin or spherical bolt adjustable by means of a differential thread and with an intermediate member is very cumbersome and costly. With an automatic, hydraulically adjustable ball pin or spherical bolt, the interchangeable intermediate compensating member serves for the coarse adjustment in order that the limited working stroke of the hydraulic compensating element is not already exhausted for the compensation of manufacturing tolerances. The valve-clearance adjustment and the coarse adjustment by means of the exchangeable intermediate compensating member is additionally complicated and time-consuming.

The present invention is therefore concerned with the task to provide a valve-actuating lever of the aforementioned type, with which the structural and manufacturing expenditures for the adjustment of the valve-clearance are reduced.

The underlying problems are solved according to the present invention in that the valve abutment surface is provided at an adjustable or interchangeable valve clearance adjusting element fixed between the lateral guide surfaces at the lever. The valve-clearance adjusting element arranged between the lateral guide surfaces requires a small structural expenditure, is very readily accessible and can be adjusted in a simple manner without significant influence on the kinematics of the valve actuation.

If a valve-actuating lever according to the present invention is constructed as rocker arm, then an axial positional securing of the rocker arm on the rocker arm shaft may be dispensed with.

A rocker arm with an eccentric arranged between two clamping surfaces as valve-clearance compensating element is known in the prior art (German Gebrauchsmuster 1,908,833); however, the prior art rocker arm does not include any lateral guide surfaces so that separate means for the positional fixing of the rocker arm on the rocker arm shaft are required.

Accordingly, it is an object of the present invention to provide a valve-actuating lever which avoids by simple means the aforementioned shortcomings and drawbacks encountered in the prior art constructions.

Another object of the present invention resides in a valve-actuating lever in which the geometric relationships of the valve actuation do not change significantly during the valve-clearance adjustment.

A further object of the present invention resides in a valve-actuating lever in which in the course of an adjustment, the control periods remain substantially unchanged, thereby leaving also substantially unchanged the output of the engine as well as the exhaust gas composition.

A still further object of the present invention resides in a valve-actuating lever which is simple in construction, relatively inexpensive in manufacture and uncomplicated in its assembly.

Another object of the present invention resides in a valve-actuation of the type described above in which the adjustment of the valve clearance is simple and relatively uncomplicated without requiring inordinate structural expenditures.

These and other objects, features and advantages of the present invention will become more apparent from the following description when taken in connection with the accompanying drawing which shows, for purposes of illustration only, several embodiments in accordance with the present invention, and wherein:

FIG. 1 is a partial cross-sectional view through a cylinder head of an internal combustion engine with a valve control which operates by means of a valve-actuating lever in accordance with the present invention constructed as drag lever;

FIG. 2 is an end elevational view of the lever according to FIG. 1 within the area of a valve clearance adjusting element;

FIG. 3 is a cross-sectional view through the lever according to FIG. 1 within the area adjoining a ball socket serving for the bearing support;

FIG. 4 is a plan view on a development of a stamping which represents the starting product for the lever according to FIGS. 1 to 3;

Figure 6:
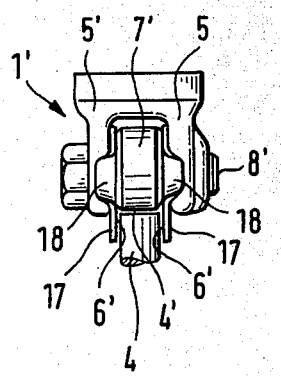
FIG. 6 is an end elevational view of the lever according to FIG. 5.

Referring now to the drawing wherein like reference numerals are used throughout the various views to designate like parts, the cross section illustrated in FIG. 1 through the cylinder head of an internal combustion engine illustrates a valve-actuating lever generally designated by reference numeral 1 pressed-out or stamped-out of sheet metal and constructed as drag lever, which is supported on a ball pin or spherical bolt 2 and is retained thereon by means of a retaining spring 3. The lever 1 includes at its end actuating a valve stem 4 two parallel clamping surfaces 5 arranged adjacent one another at a distance. The clamping surfaces 5 pass over into lateral guide surfaces 6 which guide the lever 1 along the valve stem 4. A valve-clearance adjusting element 7 constructed as eccentric is secured between the clamping surfaces 5 by a threaded bolt 8. The circumferential surface of the adjusting element 7 serves as valve abutment surface 4'. The lever 1 has an essentially U-shaped cross section and includes a slide surface 9, along which slides the cam 10 of the cam shaft 11. In proximity of the supported end, the web 12 of the U-shaped cross section is provided with a longitudinally arranged slot 13 and the flanges 14 thereof are pressed together within this area and are connected with each other at this place by a welding point or welding spot 15. In this manner, as essentially closed, spherical or ball socket 16 for the bearing support of the lever on the ball pin 2 is obtained. The retaining spring 3 pressing the lever 1 onto the ball pin 2 engages into the slot 13.

The lateral guide surfaces 6 of the lever 1 secure the position thereof during operation. The valve clearance adjusting element 7 permits a simple and rapid adjustment of the valve clearance by a simple rotation of the valve clearance element 7 on the threaded bolt 8.

Figure 5:
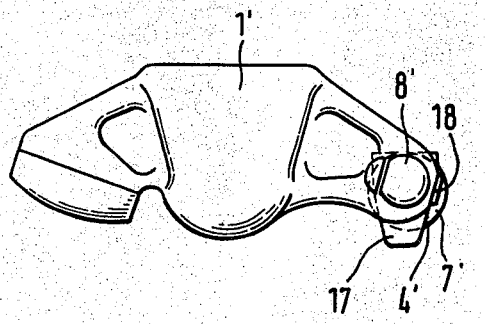
FIG. 5 is a side elevational view of a modified embodiment of a valve-actuating lever in accordance with the present invention.

In the embodiment illustrated in FIGS. 5 and 6, the lateral guide surfaces 6' are formed by insets or intermediate members 17 arranged on both sides of the valve clearance adjusting element 7' constructed as eccentric. The insets or intermediate members 17 are secured against rotation by bent-over tabs 18 which abut externally at the end face of the lever 1'.

Figure 8:
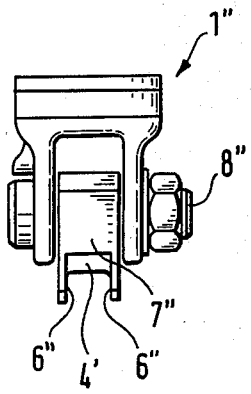
FIG. 8 is a front elevational view of the lever according to FIG. 7.
Figure 7:
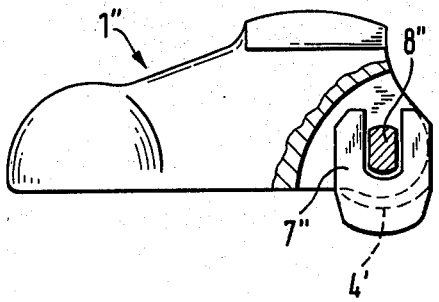
FIG. 7 is a side elevational view of a still further modified embodiment of a valve-actuating lever in accordance with the present invention, partly in cross section within the area of the valve clearance adjusting element.

In the embodiment illustrated in FIGS. 7 and 8, the lateral guide surfaces 6" are constructed as tabs which are formed-on at the valve clearance adjusting element 7" displaceable into different positions. It can be seen from FIG. 7 that the threaded bolt 8" has a flattened-off shank in order to prevent a rotation of the valve clearance adjusting element 7".

Other known constructions may also be used as valve clearance adjusting element such as, for example, an adjusting screw with counter-nut and interchangeable compensating pieces of different thicknesses or with differing or several insets.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A valve actuating lever for internal combustion engines comprising lateral guide surface means on opposed sides of a valve abutment surface means of said lever, said valve abutment surface means being provided on a valve clearance adjusting means which is positioned between said lateral guide surface means and is fixedly clamped on opposed sides by said lateral guide surface means, a portion of said lateral guide surface means extending beyond said valve abutment surface means for guiding the lever along an abutting valve so as to secure the position of the lever during operation, wherein said valve clearance adjusting means is constructed as an eccentric element which is fixedly clamped on opposed sides by said lateral guide surface means, and in which the lateral guide surface means are components of flanges of a sheet metal stamping having an essentially U-shaped cross section and provided with a bearing plate constructed as an essentially closed ball socket with the flanges adjoining the ball socket on the side thereof toward said valve clearance adjusting means converging locally into mutual contact and being connected thereat with each other by a welded connection.

2. A lever according to claim 1, characterized in that the web of the U-shaped cross section is provided with a slot arranged longitudinally of the lever within the area in which the flanges are connected with each other.

3. A lever according to claim 2, characterized in that the slot is constructed as a support opening for a retaining spring.

4. A lever according to claim 1, wherein said valve clearance adjusting means is fixedly clamped using a threaded bolt and nut, said bolt passing through said lateral guide surface means and said eccentric element.

5. A valve-actuating lever for internal combustion engines comprising lateral guide surface means on opposed sides of a valve abutment surface means of said lever, said valve abutment surface means being provided on a valve clearance adjusting means which is positioned between said lateral guide surface means and is fixedly clamped on opposed sides by said lateral guide surface means, a portion of said lateral guide surface means extending beyond said valve abutment surface means for guiding the lever along an abutting valve so as to secure the position of the lever during operation, and wherein said valve clearance adjusting means is constructed as an eccentric element which is fixedly clamped on opposed sides by said lateral guide surface means, and wherein said valve clearance adjusting means is fixedly clamped using a threaded bolt and nut, said bolt passing through said lateral guide surface means and said eccentric element.

6. A lever according to claim 5, characterized in that the valve clearance adjusting means is adjustable.

7. A lever according to claim 5, characterized in that the valve clearance adjusting means is interchangeable.

8. A lever according to claim 5, characterized in that the lever is a drag lever.

9. A lever according to claim 4, wherein said eccentric is rotatable on said threaded bolt so that before being clamped by said lateral guide surface means said eccentric element may be rotated on the bolt for adjusting the valve clearance.

10. A lever according to claim 9, wherein said lateral guide surface means comprises two parallel clamping surfaces between which said valve clearance adjusting means is fixedly clamped.

* * * * *